US006499328B2

(12) United States Patent
Faggiani et al.

(10) Patent No.: US 6,499,328 B2
(45) Date of Patent: Dec. 31, 2002

(54) COOLING DEVICE FOR ROLLING RINGS AND RELATIVE METHOD

(75) Inventors: Eddi Faggiani, Udine (IT); Fabrizio Plos, Colloredo Di Monte Albano (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 09/834,891

(22) Filed: Apr. 16, 2001

(65) Prior Publication Data

US 2002/0020204 A1 Feb. 21, 2002

(30) Foreign Application Priority Data

Apr. 20, 2000 (IT) ..... UD2000A000087

(51) Int. Cl.[7] ..... B21B 27/06
(52) U.S. Cl. ..... 72/201; 72/236
(58) Field of Search ..... 72/201, 236

(56) References Cited

U.S. PATENT DOCUMENTS 3,347,076 A 10/1967 Noda et al.
4,718,264 A * 1/1988 Guppy et al. ..... 72/201
4,741,123 A * 5/1988 Kimura et al. ..... 72/201
4,934,444 A * 6/1990 Frischknecht et al. ..... 164/480
4,974,437 A 12/1990 Schiller
5,473,924 A * 12/1995 Collinson ..... 72/236
5,855,134 A * 1/1999 Womelsdorf et al. ..... 72/201
6,385,989 B1 * 5/2002 Cassidy ..... 62/373

FOREIGN PATENT DOCUMENTS

| | | |
|---|---|---|
| DE | 913044 | 9/1953 |
| JP | 54083658 | 7/1979 |
| JP | 60199504 | 10/1985 |
| JP | 01254303 | 10/1989 |
| JP | 04046613 | 5/1992 |
| JP | 10137822 | 5/1998 |

* cited by examiner

*Primary Examiner*—Ed Tolan
(74) *Attorney, Agent, or Firm*—Stevens, Davis, Miller Mosher, LLP

(57) ABSTRACT

A device and method for cooling rolling rings or rolls in a rolling stand for long products. The stand including supporting chocks for the rolls and equipment to deliver a cooling fluid onto the surface of the rings or rolls. The equipment for delivering the cooling fluid including at least a curved collector arranged around at least part of a circumference of the rings or rolls and including a port to deliver the cooling fluid. The collector being mounted on a support fixedly anchored to at least one chock of a respective roll.

16 Claims, 3 Drawing Sheets

COOLING DEVICE FOR ROLLING RINGS AND RELATIVE METHOD

FIELD OF THE INVENTION

This invention concerns a device to cool the rolling rings in a rolling stand for long products, and the method performed with the device.

The invention is applied in co-operation with rolling stands used to roll long products such as bars, round pieces, wires or profiles in general.

BACKGROUND OF THE INVENTION

The state of the art provides cooling systems associated with rolling stands and predisposed to deliver jets of a cooling fluid, normally water, onto the surface of the rings or working rolls of the stands. It is well-known that the over-heating of these surfaces, caused by the repeated rolling passes in contact with the hot surface of the product to be rolled, generates premature wear on the rings-rolls and rolling conditions which are not ideal.

Normally, therefore, cooling systems are provided comprising nozzles to deliver fluid mounted on collectors arranged in co-operation with the periphery of the rings.

The collectors are mounted fixed on the housing of the stand, at a certain distance from the surface to be cooled, and are arranged so as to cover, with the relative delivery nozzles, a part of the circumference of the rings-rolls.

One problem deriving from using such systems is that, due to the fixed position of the collectors, the distance between the delivery nozzles and the surface to be cooled is modified every time that the rolling rolls are adjusted to define a different gap value.

Moreover, it is well-known that the rolling rings are subjected to periodic operations of surface re-working to restore the geometric shape of the rolling channels which deteriorates and deforms due to the wear induced by the rolling passes.

Each of said re-working operations causes a reduction in the diameter of the ring, which can be as much as 15–20% with respect to its original value before it is necessary to replace it.

The modification in the distance between the nozzles and the surface to be cooled, due to the reasons explained above, causes a variation in the cooling conditions, which depend mainly on the flow rate of water and pressure of impact against said surface.

Since the pressure of impact rapidly diminishes as the distance from the delivery point increases, with approximately a quadratic function, it is obvious that even a small modification of the distance entails high variations in the cooling parameters. The fact that cooling depends on the working conditions causes serious operating disadvantages since it does not make possible to guarantee a sure control of the temperature of the rings and therefore reduces the efficiency and reliability of the cooling system.

Moreover, the non-ideal working conditions of the rolls, which may be subject to overheating caused by ineffective cooling, cause a premature wear thereon with a consequent reduction in their average working life.

Another disadvantage is that, due to the variable distance between the nozzles and the surface to be cooled, uncontrolled sprays of cooling fluid may be generated which hit the whole stand.

Documents JP-A-60-199504, U.S. Pat. No. 4,974,437, JP-A-04-046613, JP-A-01-254303 and JP-A-54-083658 disclose all cooling devices in rolling stands for plane products such as strips or sheets; these cooling devices comprise nozzles which are solid with the chocks and are placed along a line which is parallel to the axis of the relative rolling roll.

These devices cannot be efficiently applied to cool, in an effective and uniform way, the surface of rolling rings or rolls in rolling stands for long products, because the relative nozzles are not placed around a substantial part of the surface of these rolls.

DE-C-913.044 discloses a cooling device for rolling rings or rolls in a rolling stand for long products, in which the nozzles are placed on a tube parallel to the axis of the ring or roll; this tube is not solid with a relative chock and does not follow the movements of the chock during shifting or gap control.

The present Applicant has devised, tested and embodied this invention to overcome these shortcomings and to obtain further advantages.

SUMMARY OF THE INVENTION

The invention is set forth and characterized in the respective main claims, while the dependent claims describe other characteristics of the main embodiment.

The purpose of the invention is to achieve a cooling device for rolling rings in rolling stands for long products, and the relative method, such as to ensure efficient and constant cooling conditions even when there is a variation in the working parameters, such as those caused by a modification to the gap between the rolls or those caused by variations in the diameter of the rolls generated by re-working and grinding.

To be more exact, the purpose of the invention is to guarantee that the distance between the surface of the ring and the point where the cooling fluid is delivered by the relative delivery means is substantially constant; this is to ensure, once the desired parameters have been set, that efficient cooling conditions are maintained.

The cooling device comprises a plurality of curved collectors arranged around and in cooperation with a substantial part of the circumference of the rolling rolls.

Each of the collectors is able to support a plurality of delivery elements, such as nozzles, apertures or similar, facing towards the surface to be cooled and suitable to deliver a jet of cooling fluid onto said surface.

According to one characteristic of the invention, the collectors are mounted on a support solid with at least a chock of the relative roll.

In this way, with every new adjustment of the gap between the rolls, and consequent modification to the reciprocal position of the chocks, the collectors are displaced together with the chocks, so that their position with respect to the surface of the rolls remains substantially constant for any value of the gap.

According to another characteristic, the collectors are interchangeable with other collectors which are identical except that they have a different size, correlated at least to the different diameter of the rings/rolls.

According to a variant, the collectors can be displaced in a controlled manner towards the surface of the roll and with respect to their fixed support which is solid with the relative chock.

Therefore, every time the rolls/rings are removed for surface re-working and grinding, with a consequent modification to their diameter, the collectors are either replaced by others with a different size, or their assembly position is modified, so as to guarantee that the distance between the surface of the roll and the point where the cooling fluid is delivered remains substantially constant.

According to a variant, the position of the collectors can be modified so as to vary, or also vary, the intensity of the cooling to the surface of the rolls.

In a first embodiment, the position of the collectors is adjusted by a mechanical adjustment to their assembly position on the relative support and with respect to the surface of the roll. In another embodiment, the adjustment is made substantially automatically by means of positioning actuators which are associated with said support and can be remote commanded.

In a further embodiment, the adjustment to the position of the collectors is made by means of a control unit able to manage the functioning of the rolling stand; when the rolls have a new diameter value after grinding and/or according to the gap value set, the control unit automatically adjusts the position of the collectors to guarantee that the distance between the nozzles and the surface is constant.

In a further evolution, the collectors, or at least some of them, can be translated along the relative support in a direction substantially parallel to the axis of the rolls, so that they can be centered with respect to the rolling channels affected by the passage of the rolled stock.

According to a first embodiment, the collectors are translated mechanically; according to a variant, they are translated automatically by means of actuators associated with a control unit.

According to the invention, on the outer part of the support on which the collectors are mounted, there are fitting elements by means of which the collectors are connected to flexible conduits able to feed the cooling fluid to the delivery nozzles. By using flexible conduits it is possible to displace the collectors towards the surface of the rolls and/or parallel thereto without entailing problems in the feed of the cooling fluid.

Using the invention guarantees that the distance between the delivery nozzles and the surface of the rolls is constant, and thus ensures efficient and constant cooling conditions even when the working conditions of the rolls themselves varies.

This also gives an increase in the average working life of the roll. Moreover, the fact that the distance between the delivery nozzles and the surface of the rolls is constant prevents the stand from being hit by unwanted sprays of cooling fluid.

A further advantage is that the flexible conduits are arranged and extend outside the support of the collectors and therefore are in a position protected from overheating and knocks or mechanical damage.

BRIEF DESCRIPTION OF THE DRAWINGS

These and other characteristics of the invention will be clear from the following description of a preferential embodiment, given as a non-restrictive example with reference to the attached drawings wherein.

DETAILED DESCRIPTION OF PREFERENTIAL EMBODIMENT

Figure 1:
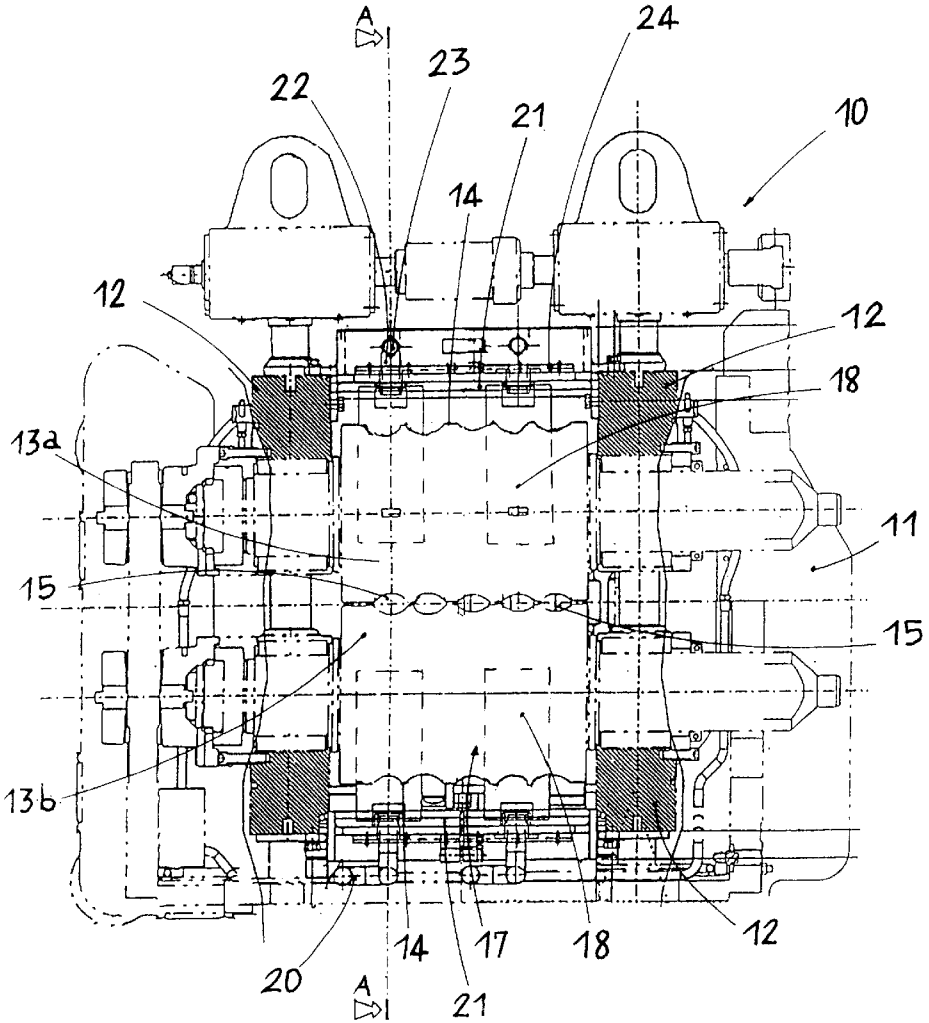
FIG. 1 is a front view, partly in section, of a rolling stand for long products to which the invention is applied.
Figure 2:
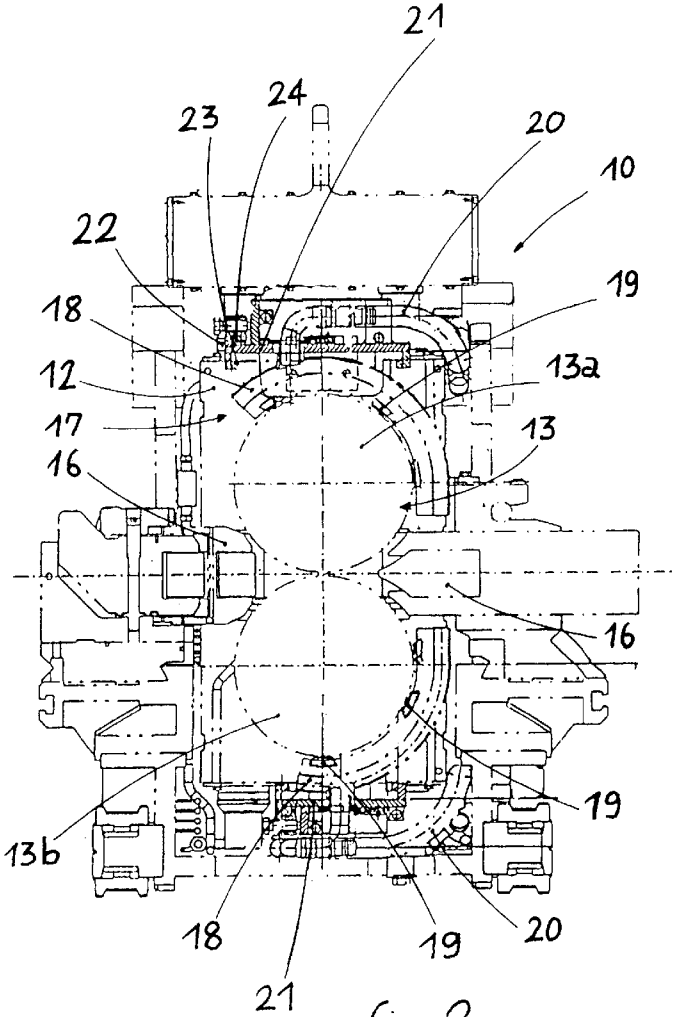
FIG. 2 is the section from A to A of FIG. 1.
Figure 3:
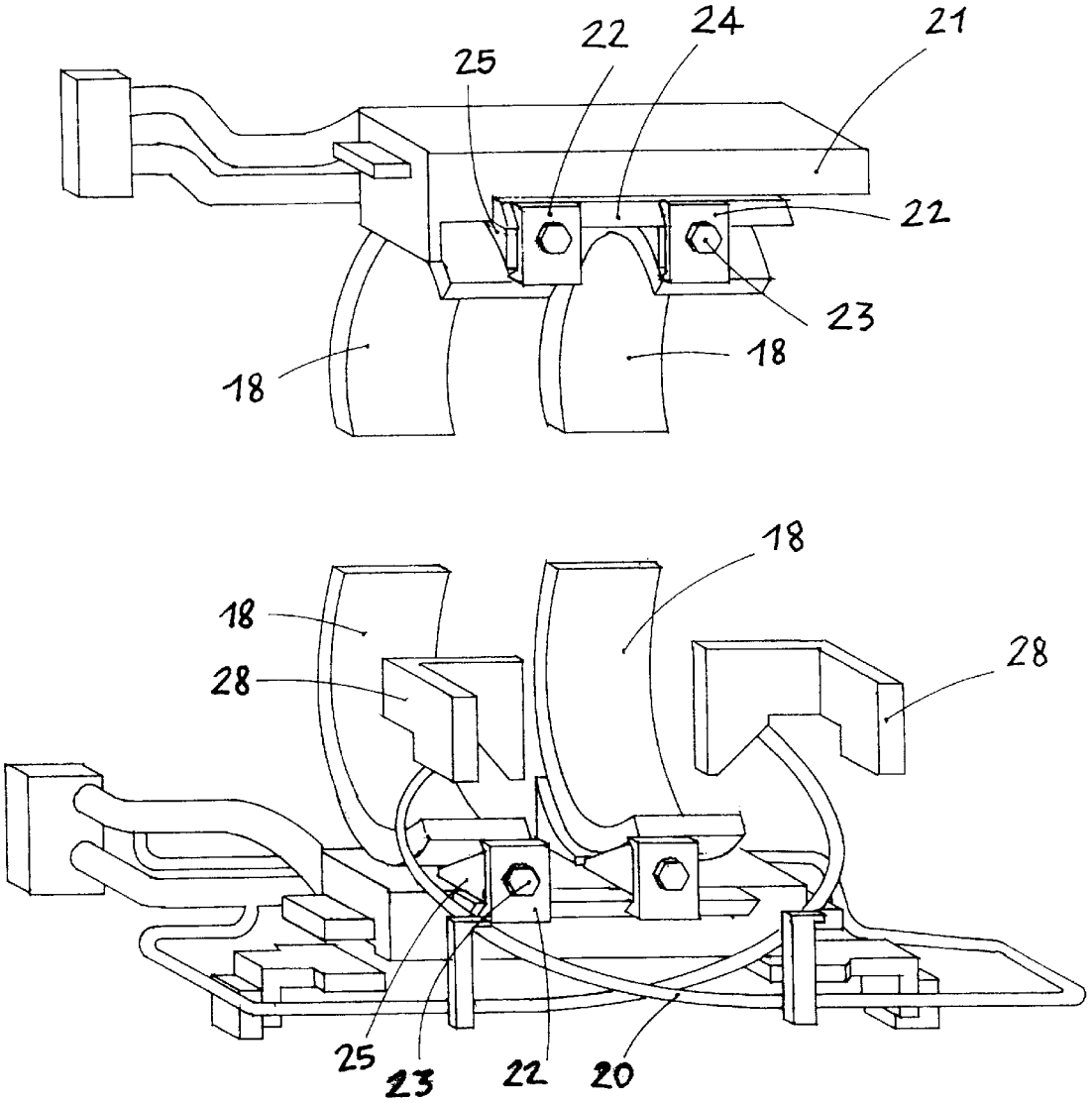
FIG. 3 shows the cooling device according to the invention in its dis-assembled state.

With reference to the attached Figures, the reference number 10 denotes generally a rolling stand which is of the type for rolling long products such as profiles, round pieces or similar.

The stand 10 substantially consists of a supporting housing 11 on which chocks 12, two per side, to support a pair of rolling rolls 13, respectively upper 13*a* and lower 13*b*, are attached. The chocks 12 have respective holes 12*a* on which to mount the rolls 13 and through which the relative shafts pass.

In this case a plurality of rings 14 are keyed onto the rolls 13; the rings 14 are able to define rolling channels 15 inside which a multi-profile rolled product is sent to be rolled. Upstream and downstream of the rolls 13 there are conventional boxes 16 to guide the rolled product, suitable to introduce the multi-profile rolled product into the channels 15 correctly.

All this is part of the state of the art, and the rolling stand 10 is not described in any further detail here, inasmuch as other details are irrelevant for the purposes of understanding the invention.

In cooperation with each of said rolls 13 there are means 17 to deliver a cooling fluid against the surface of the rings 14, in order to prevent them from over-heating due to the successive rolling passes.

The means 17 comprise, for each of the two rolls 13*a*, 13*b*, one or more, in this case two, collector units 18, curved in shape and arranged around and in cooperation with a substantial part of the circumference of the rolls 13.

The collector units 18 support a plurality of nozzles 19 facing the surface of the rings 14 and able to deliver a controlled jet of cooling fluid against the surface, and in particular against the grooves between the rings 14 which define the rolling channels 15.

The collectors 18 are able to be fed with the cooling fluid through respective flexible conduits 20 and to send the cooling fluid to the various nozzles 19.

The collectors 18, respectively upper and lower, are mounted on respective cross-pieces 21 solid with the relative chocks 12 and arranged substantially parallel to the axis of the rolls 13.

Each of the collectors 18 is mounted on the cross-pieces 21 by means of a relative bracket 22 attached by means of a screw or bolt 23.

The bracket 22, solidly connected to the relative collector 18 by means of an anchoring plate 25, has a substantially U-shaped conformation at the upper part and is able to attach itself on a mating protruding tooth 24 of the cross-piece 21.

Therefore, by loosening the screw or bolt 23 the bracket 22 with its relative collector 18 can be made to slide along the edge 24, which acts therefore substantially as a rail, to allow the collector 18 to be translated in a direction parallel to the axis of the rolls 13, in order to center the position of the collector 18 and the relative nozzles 19 with respect to the rolling channels 15.

Each collector 18, being solid with the relative chock 12, follows any possible displacement thereof, made for example to adjust the gap between the rolls 13 to a new value. In this way we obtain that, for whatever new and different gap value, the distance between the collectors 18 and the surface of the rings 14 or rolls 13 remains substantially constant and independent from the gap value, ensuring that efficient and constant cooling conditions are maintained.

In one embodiment of the invention, each collector 18 can be either replaced by another, identical one but with a different size, or can be radially displaced with respect to the axis of the rolls 13.

This makes possible to modify the position of the delivery point of the cooling fluid based on a variation in the diameter of the rings 14, and hence on a modification to the distance between the surface of the rings 14 and the nozzles 19.

The radial displacement or replacement of the collectors 18 is carried out particularly in the event that the rolls 13 are re-worked and have their surface ground, and their diameter is consequently modified.

In the event that the collectors 18 are to be displaced with respect to the relative cross-piece 21, a first solution of the invention provides that this displacement is made manually and with mechanical means. A first embodiment provides to modify the assembly position of the collectors 18 with respect to the rolls 13 by inserting thicknesses between the relative bracket 22 and the protruding tooth 24 of the cross-piece 21.

Another embodiment provides that there are several holes on the cross-piece 21, inside which the relative screw or bolt 23 can be inserted to modify the assembly position of the relative collector 18 with respect to the roll 13.

Figure 5:
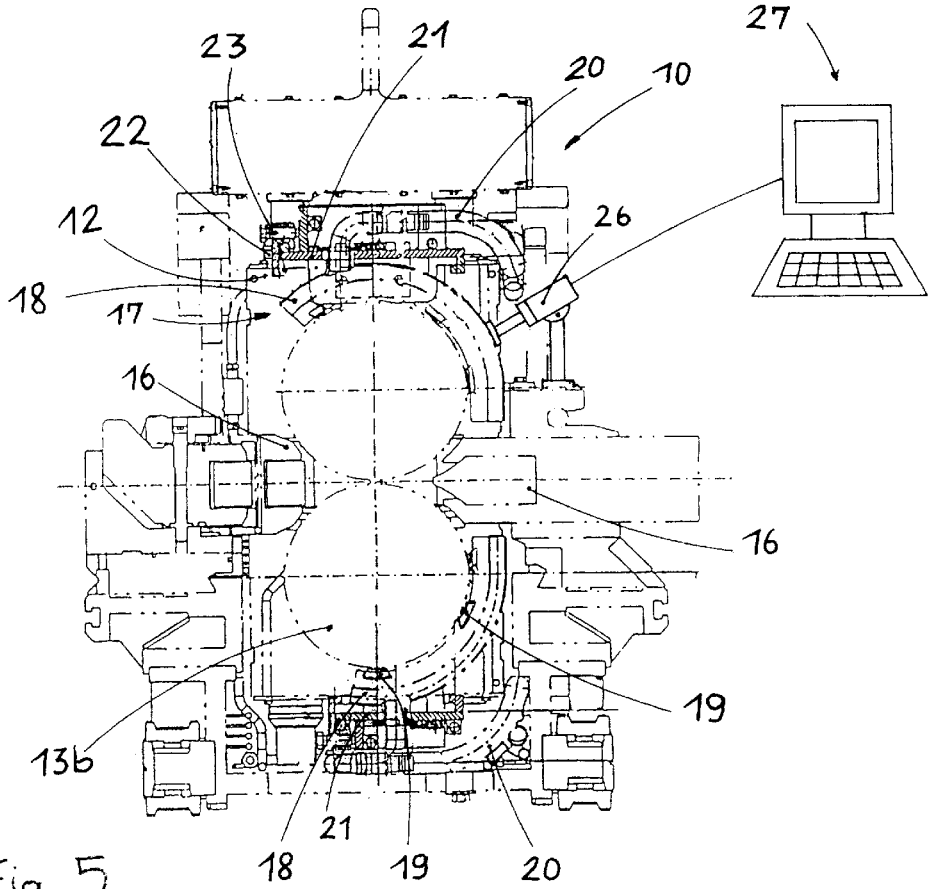
FIG. 5 shows a variant of FIG. 1.
Figure 4:
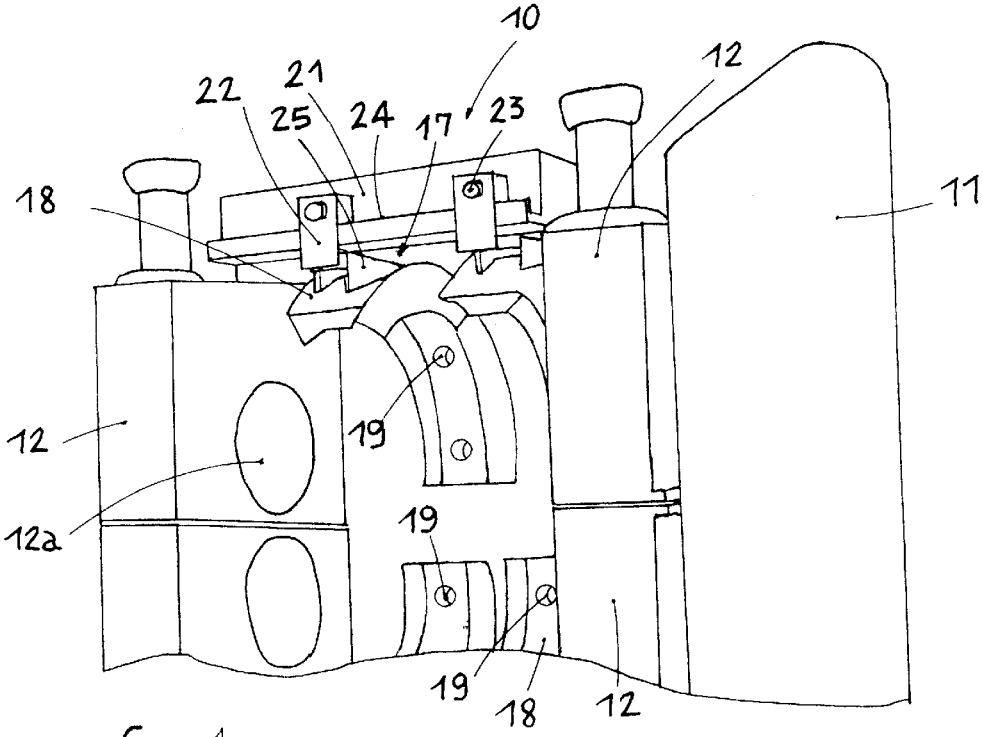
FIG. 4 is a partial prospective view of a rolling stand for long products to which the invention is applied.

Another embodiment, shown schematically in FIG. 5, provides that the adjustment to the position of the collectors 18 with respect to the rolls 13 is made by means of actuator means 26, for example of the type with a pneumatic, hydraulic or electric jack, endless screw or other type.

The activation of the actuator means 26 is governed by a remote command unit 27 which can be supplied with the data relating to the new diameter of the rolls 13 after they have been re-worked or ground and/or relating to the gap of the rolls 13. According to this data, the actuators 26 are activated to move the collectors 18 in order to maintain the distance between the nozzles 19 and the surface of the rolls 13 constant, irrespective of the working conditions of the stand 10 and the rolls 13.

On the outer part of each of the cross-pieces 21 coupling elements 28 are fixed which allow to connect the collectors 18 and the flexible conduits 20, which convey the cooling water.

The flexible conduits 20 are therefore positioned in an outer zone, protected both from overheating and also from knocks and damage.

Modifications and variants may be made to this invention, but these shall remain within the field and scope thereof.

We claim:

1. A device for cooling rolling rings (14) or rolls (13) in a rolling stand (10), said stand (10) comprising supporting chocks (12) for said rolls (13) and means (17, 18, 19) to deliver a cooling fluid onto the surface of said rings (14) or rolls (13), wherein said means (17, 18, 19) to deliver the cooling fluid comprise at least a curved collector (18), arranged around at least part of the circumference of said rings (14) or rolls (13), and delivery means (19), said collector (18) being mounted on a support (21) solidly anchored to at least one chock (12) of a relative roll (13) said device further comprising bracket means (22) able to attach said collector (18) to the relative support (21), said bracket means (22) have a substantially U-shaped conformation at the upper part able to attach itself on a mating tooth (24) of said support (21) wherein said tooth (24) is able to allow said bracket means (22) and the relative collector (18) to slide in a direction substantially parallel to the axis of said rolls (13) in order to permit said delivery means (19) to be centered with respect to rolling channels (15) defined between said rings (14).

2. The device as in claim 1, wherein said support (21) extends substantially parallel with respect to the axis of said rolls (13).

3. The device as in claim 1, wherein said collector (18) is replaceable and inter-changeable with other collectors having a different size according to the value of the diameter of said rings (14) or rolls (13).

4. The device as in claim 1, comprising adjustment means able to adjust the assembly position of said collector (18) with respect to the relative support (21) in order that the distance between the point at which the cooling fluid is delivered and the surface of said rings (14)/rolls (13) is maintained constant.

5. The device as in claim 4, wherein said adjustment means comprise thicknesses able to be inserted between said bracket (22) and said support (21) to modify the assembly position of said collector (18) with respect to the surface of the rolls (13).

6. The device as in claim 4, wherein said adjustment means comprise differentiated anchorage elements made on said support (21) for said bracket means (22) in order to modify the assembly position of said collector (18) with respect to the surface of the rolls (13).

7. The device as in claim 4, wherein said adjustment means comprise actuator means (26) able to automatically modify the assembly position of said collector (18) according to the commands given by a control unit (27).

8. The device as in claim 1, comprising connection coupling elements (28) able to be attached on the outer part of said supports (21) and to connect said collector (18) with flexible conduits (20) which feed the cooling fluid.

9. The device as in claim 1, wherein each said support (21) is able to support two or more of said collectors (18).

10. A method for cooling rolling rings (14) or rolls (13) in a rolling stand (10), comprising the steps of:

providing said stand (10) comprising supporting chocks (12) for said rolls (13) and means (17, 18, 19) to deliver a cooling fluid onto tie surface of said rings (14) or rolls (13), wherein said means to deliver a cooling fluid comprise at least a curved collector (18) arranged around at least part of the circumference of said rings (14) or rolls (13), and modifying the position of at least said curved collector (18) in order that the distance between a point of delivery of the cooling fluid and the surface of said rings (14)/rolls (13) is kept constant, irrespective of their working conditions wherein the position of said means (17, 18, 19) to deliver the cooling fluid is modifiable in a direction substantially parallel to the axis of said rolls (13) in order to center said delivery means (17, 18, 19) with respect to rolling channels (15) defined between said rings (14).

11. The method as in claim 10, wherein said means (17, 18, 19) to deliver the cooling fluid is mounted solidly with at least one of the chocks (12) which support said rolls (13), so that the position of said means (17, 18, 19) to deliver the cooling fluid is modified together with the variation in the reciprocal position of said chocks (12) after every adjustment to the rolls (13) such as to modify the roll gap value, the distance between said delivery point and the surface of said rolls (13) remaining always constant.

12. The method as in claim 10, wherein said means (17, 18, 19) to deliver the cooling fluid is replaced with other identical means but of a different size, after every re-working or grinding of the surface of the rolls (13) such as to vary the diameter of the rolls (13).

13. The method as in claim 10, wherein the position of the means (17, 18, 19) to deliver the cooling fluid is modified after every re-working or grinding of the surface of the rolls (13) such as to reduce the diameter of the rolls (13).

14. The method as in claim 13, wherein the position of the means (17, 18, 19) to deliver the cooling fluid is modified manually by mechanical meals.

15. The method as in claim 13, wherein the position of the means (17, 18, 19) to deliver the cooling fluid is modified automatically by actuator means.

16. The method as in claim 15, wherein the activation of said actuator means (26) is governed by the commands of a control unit (27) which receives data relating at least to the new diameter of the rolls (13) after the surface of the rolls has been re-worked or ground, or relating to a new value of the gap between the rolls (13).

* * * * *